US011468822B2

(12) United States Patent
Ji et al.

(10) Patent No.: US 11,468,822 B2
(45) Date of Patent: Oct. 11, 2022

(54) TIMING CONTROL BOARD, DRIVE DEVICE AND DISPLAY DEVICE

(71) Applicants: CHONGQING HKC OPTOELECTRONICS TECHNOLOGY CO., LTD., Chongqing (CN); HKC CORPORATION LIMITED, Guangdong (CN)

(72) Inventors: Feilin Ji, Chongqing (CN); Wei Li, Chongqing (CN)

(73) Assignees: CHONGQING HKC OPTOELECTRONICS TECHNOLOGY CO., LTD., Chongqing (CN); HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/163,895

(22) Filed: Feb. 1, 2021

(65) Prior Publication Data

US 2022/0036805 A1 Feb. 3, 2022

(30) Foreign Application Priority Data

Jul. 28, 2020 (CN) ..... 202010740656.2

(51) Int. Cl.
*G09G 3/20* (2006.01)

(52) U.S. Cl.
CPC ..... *G09G 3/2096* (2013.01); *G09G 2310/08* (2013.01); *G09G 2370/08* (2013.01)

(58) Field of Classification Search
CPC ..... G09G 2370/08
See application file for complete search history.

(56) References Cited

U.S. PATENT DOCUMENTS

2010/0156879 A1* 6/2010 Hong ..... G09G 3/3648 345/213
2016/0042699 A1* 2/2016 Min ..... G09G 3/3413 345/82

(Continued)

FOREIGN PATENT DOCUMENTS

CN 105261323 A 1/2016
CN 105976780 A 9/2016

(Continued)

OTHER PUBLICATIONS

First Office Action issued in counterpart Chinese Patent Application No. 202010740656.2, dated Jun. 30, 2022.

*Primary Examiner* — William Boddie
*Assistant Examiner* — Bipin Gyawali
(74) *Attorney, Agent, or Firm* — Westbridge IP LLC

(57) ABSTRACT

A timing control board includes a point-to-point interface, a plurality of storage modules and a timing controller. The point-to-point interface is for connecting a source drive circuit board and performing point-to-point signal transmission. The storage modules each stores a set of point-to-point configuration parameters. The timing controller receives a configuration parameter feedback signal from the source drive circuit board, and outputs a corresponding chip selection signal to the storage modules according to the configuration parameter feedback signal, to obtain a set of point-to-point configuration parameters matching a protocol type of the source drive circuit board from the storage modules, and initialize setting according to the point-to-point configuration parameters to generate matched data signals and clock signals and output the data signals and clock signals to the source drive circuit board through the point-to-point interface.

16 Claims, 3 Drawing Sheets

(56) References Cited

U.S. PATENT DOCUMENTS

| | | | | |
|---|---|---|---|---|
| 2017/0025087 | A1* | 1/2017 | Liu | G09G 5/006 |
| 2021/0082335 | A1* | 3/2021 | Sun | G09G 3/2096 |
| 2021/0241700 | A1* | 8/2021 | Kwon | G09G 3/20 |

FOREIGN PATENT DOCUMENTS

| | | | |
|---|---|---|---|
| CN | 106970888 | A | 7/2017 |
| CN | 109599136 | A | 4/2019 |
| CN | 110459154 | A | 11/2019 |

* cited by examiner

TIMING CONTROL BOARD, DRIVE DEVICE AND DISPLAY DEVICE

CROSS-REFERENCE TO RELATED APPLICATIONS

The present disclosure claims the benefit of a Chinese patent application no. 202010740656.2, filed on Jul. 28, 2020, entitled "Timing Control Board, Drive Device and Display Device", the entire content of which is incorporated herein for reference.

TECHNICAL FIELD

The present disclosure relates to the technical field of display panels, in particular to a timing control board, a drive device and a display device.

BACKGROUND

The statements herein only provide background information related to this disclosure and does not necessarily constitute prior art.

With the development of TV display panel technology, consumers have higher and higher requirements for display, and panels are also developing towards large size and high resolution. At present, UHD (Ultra High Definition) resolution has become the mainstream on the market. The mini-LVDS (Mini Low Voltage Differential Signaling) interface and point-to-point interface are commonly used between the timing control board and the source drive circuit board. Compared with the mini-LVDS interface, the point-to-point interface has higher transmission rate, higher transmission data capacity and stronger anti-electromagnetic interference capability, and represents a new development trend of interface technology.

At present, different point-to-point interface technology are applied by different manufacturers, and there is no unified protocol for the point-to-point interface technology. For example, Samsung uses USI-T (Unified Standard Interface) protocol type display panels, while other manufacturers use other protocol type display panels, such as ISP (In-System Programming) protocol, and etc. Therefore, for display panels supporting different protocol types, timing control boards need to be designed separately, resulting in increased design costs.

SUMMARY

The present disclosure provides a timing control board for a display panel, which includes:

a point-to-point interface for connecting a source drive circuit board and performing point-to-point signal transmission;

a plurality of storage modules, each of the plurality of storage modules storing a set of point-to-point configuration parameters, and sets of point-to-point configuration parameters stored in the plurality of storage modules are different from each other; and a timing controller connected with the point-to-point interface, the source drive circuit board and the plurality of storage modules, and provided with at least one common port to connect with a signal terminal of the source drive circuit board, the timing controller is for receiving a configuration parameter feedback signal output by the source drive circuit board through the common port, and outputting a corresponding chip selection signal to the plurality of storage modules according to the configuration parameter feedback signal, to obtain a set of point-to-point configuration parameters matching a protocol type of the source drive circuit board from one of the plurality of storage modules, and initializing settings according to the set of point-to-point configuration parameters to generate matched data signals and clock signals and output the data signals and the clock signals to the source drive circuit board through the point-to-point interface.

In an embodiment, the common port is connected to a pull-up resistor circuit or a pull-down resistor circuit of the source drive circuit board;

the timing controller is for receiving the configuration parameter feedback signal output by the pull-up resistor circuit or the pull-down resistor circuit of the source drive circuit board through the common port.

In an embodiment, the timing control board further includes a signal input interface for receiving a synchronous drive signal for driving the display panel.

In an embodiment, the point-to-point interface includes a first signal interface and a second signal interface, the timing controller is for outputting the clock signals and the data signals through the first signal interface, and outputting a level synchronization signal through the second signal interface, the level synchronization signal is for identifying a level state for clock synchronization between the timing controller and the source drive circuit board in conjunction with the first signal interface.

In an embodiment, each of the plurality of storage modules is a flash memory or a read-only memory.

In an embodiment, the timing control board further includes a connector for connecting the point-to-point interface and the source drive circuit board.

In an embodiment, that connector is a flexible circuit board connector.

In an embodiment, the timing controller is connected to the plurality of storage modules through a serial peripheral interface.

The present disclosure also provides a timing control board for a display panel, which includes:

a point-to-point interface for connecting a source drive circuit board and performing point-to-point signal transmission, and including a first signal interface and a second signal interface;

a plurality of storage modules, each of the plurality of storage modules storing a set of point-to-point configuration parameters, and sets of point-to-point configuration parameters stored in the plurality of storage modules being different from each other; and a timing controller connected with the point-to-point interface, the source drive circuit board and the plurality of storage modules, and provided with at least one common port to connect with a pull-up resistor circuit or a pull-down resistor circuit of the source drive circuit board;

the timing controller is for receiving a configuration parameter feedback signal output by the source drive circuit board through the common port, and outputting a corresponding chip selection signal to the plurality of storage modules according to the configuration parameter feedback signal, to obtain a set of point-to-point configuration parameters matching a protocol type of the source drive circuit board from one of the plurality of storage modules, and initializing settings according to the set of point-to-point configuration parameters to generate matched data signals and clock signals and output the data signals and the clock signals to the source drive circuit board through the point-to-point interface;

the timing controller is further for outputting the clock signals and the data signals through the first signal interface, and outputting a level synchronization signal through the second signal interface, the level synchronization signal is for identifying a level state for clock synchronization between the timing controller and the source drive circuit board in conjunction with the first signal interface.

The present disclosure also provides a drive device. The drive device includes a source drive circuit board, a gate drive circuit board and a timing control board as described above. The timing control board is connected with the source drive circuit board and the gate drive circuit board, the source drive circuit board and the gate drive circuit board are respectively connected with a data line and a scanning line of the display panel, and are respectively for outputting analog gray scale voltage signals and row scanning signals to drive the display panel.

The present disclosure further provides a display device including a display panel and the drive device as described above, a signal terminal of the display panel being connected to a signal terminal of the drive device.

Embodiments of the present disclosure adopts a point-to-point interface, a plurality of storage modules and a timing controller to form a timing control board. The point-to-point interface is for connecting a source drive circuit board and performing point-to-point signal transmission. The plurality of storage modules each stores a set of point-to-point configuration parameters, and sets of point-to-point configuration parameters stored in the plurality of storage modules are different from each other. At least one common port is also provided on the timing controller. The common port is connected to a signal terminal of the source drive circuit board. The timing controller receives a configuration parameter feedback signal output from the source drive circuit board through the common port, and outputs a corresponding chip selection signal to the plurality of storage modules according to the configuration parameter feedback signal, so as to obtain a set of point-to-point configuration parameters matching a protocol type of the source drive circuit board from one of the plurality of storage modules, and initialize settings according to the set of point-to-point configuration parameters to generate matched data signals and clock signals and output the data signals and the clock signals to the source drive circuit board through the point-to-point interface, thereby realizing compatibility of the display panels and reduce the design cost.

BRIEF DESCRIPTION OF THE DRAWINGS

In order to more clearly illustrate the embodiments of the present disclosure, drawings used in the embodiments will be briefly described below. Obviously, the drawings in the following description are only some embodiments of the present disclosure. It will be apparent to those skilled in the art that other figures can be obtained according to the structures shown in the drawings without creative work.

The realization of purpose, functional features and advantages of the present disclosure will be further explained in connection with embodiments and with reference to the accompanying drawings.

DETAILED DESCRIPTION OF THE EMBODIMENTS

The technical solutions of the embodiments of the present disclosure will be described in more detail below with reference to the accompanying drawings. It is obvious that the embodiments to be described are only some rather than all of the embodiments of the present disclosure. All other embodiments obtained by persons skilled in the art based on the embodiments of the present disclosure without creative efforts shall fall within the scope of the present disclosure.

It should be noted that, the descriptions associated with, e.g., "first" and "second," in the present disclosure are merely for descriptive purposes, and cannot be understood as indicating or suggesting relative importance or impliedly indicating the number of the indicated technical feature. Therefore, the feature associated with "first" or "second" can expressly or impliedly include at least one such feature. Besides, the meaning of "and/or" appearing in the disclosure includes three parallel scenarios. For example, "A and/or B" includes only A, or only B, or both A and B. In addition, the technical solutions between the various embodiments can be combined with each other, but they must be based on the realization of those of ordinary skill in the art. When the combination of technical solutions is contradictory or cannot be achieved, it should be considered that such a combination of technical solutions does not exist, nor is it within the scope of the present disclosure.

The present disclosure provides a timing control board 100 for a display panel 300.

Figure 1:
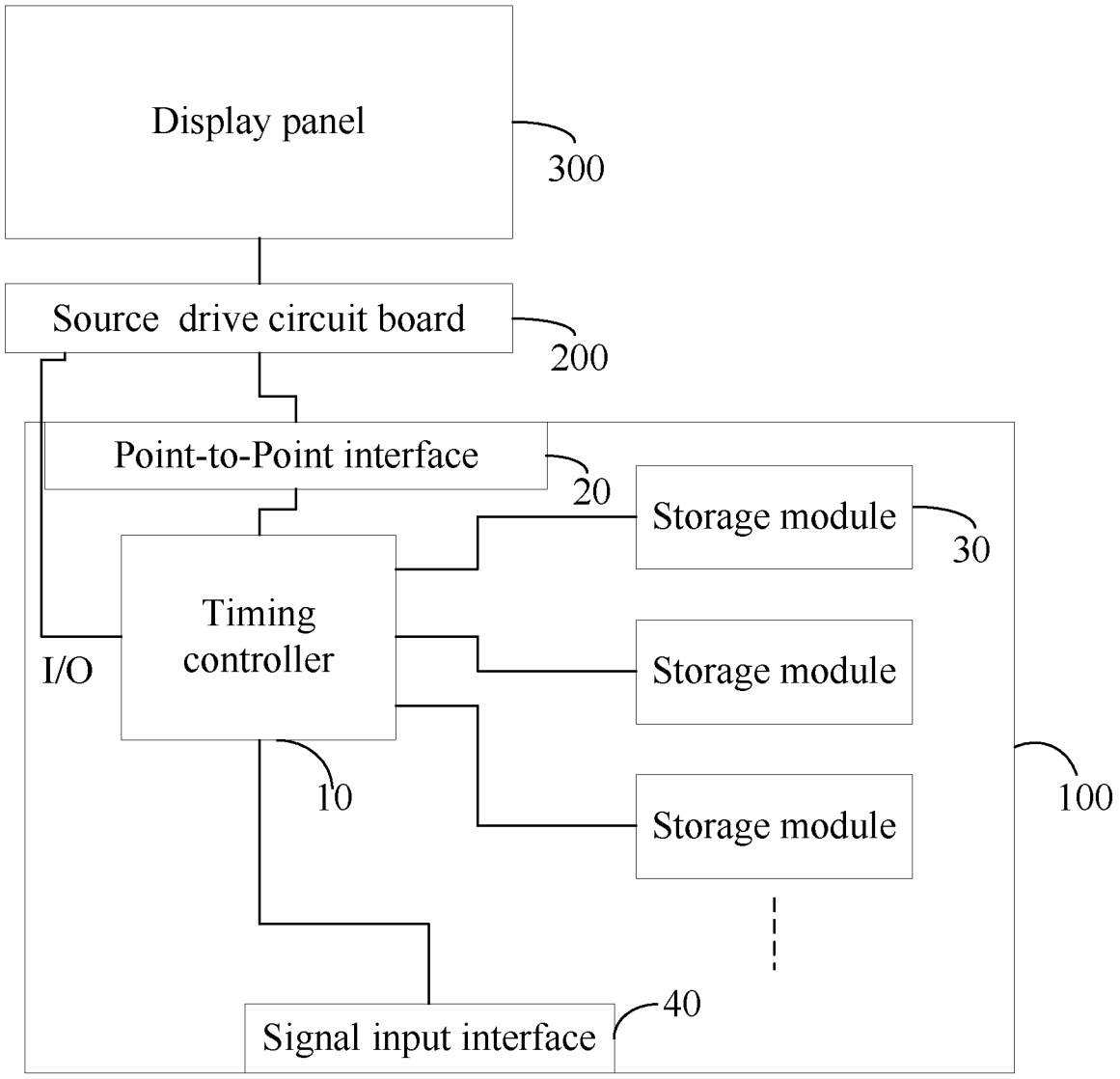
FIG. 1 is a block diagram of a first embodiment of a timing control board of the present disclosure.

As shown in FIG. 1, FIG. 1 is a block diagram of a first embodiment of the timing control board of the present disclosure. In this embodiment, the timing control board 100 includes:

a point-to-point interface 20 for connecting a source drive circuit board 200 of the display panel 300 and performing point-to-point signal transmission;

a plurality of storage modules 30, each of the storage modules 30 being for storing a set of point-to-point configuration parameters, and point-to-point configuration parameters stored by the plurality of storage modules are different from each other; and a timing controller 10 connected with the point-to-point interface 20, the source drive circuit board 200 and the plurality of storage modules 30, and provided with at least one common port I/O connected with a signal terminal of the source drive circuit board 200.

The time controller 10 is provided to receive a configuration parameter feedback signal output by the source drive circuit board 200 through the common port I/O, and output a corresponding chip selection signal to the plurality of storage modules according to the configuration parameter feedback signal, to obtain a set of point-to-point configuration parameters of one of the plurality of storage modules 30 that matches a protocol type of the source drive circuit board 200, and initialize settings according to the set of point-to-point configuration parameters to generate matched data signals and clock signals and output the data signals and clock signals to the source drive circuit board 200 via the point-to-point interface.

In this embodiment, the point-to-point interface 20, the plurality of storage modules 30 and the timing controller 10 are all provided on a circuit board, and the timing control board 100 is also provided with a power management integrated circuit (not shown), a gamma circuit (not shown), a common electrode voltage circuit (not shown), etc. An input voltage at an input terminal of the power management integrated circuit is generally 5V or 12V, and output voltage of the power management integrated circuit includes a digital working voltage supplied to each drive chip, analog voltages supplied to the gamma circuit and the common electrode voltage circuit, a gate turning on voltage and a gate turning off voltage supplied to a gate drive chip. The voltage signals output by the power management integrated circuit and the common electrode voltage circuit are also output to the source drive circuit board 200 or a gate drive circuit board through connectors.

A signal input interface 40 is also provided on the timing control board 100. The timing controller 10 is connected to a system main board of the display device through the signal input interface 40. A type of the signal input interface 40 on the timing control board 100 can be a low voltage differential signal interface, an embedded display signal interface, a transistor-transistor logic signal interface, or a V-by-one interface. In this embodiment, the type of the signal input interface 40 is not specifically limited.

Synchronization drive signals input to the timing control board 100 via the signal input interface 40 include clock signals, row synchronization signals, field synchronization signals and enable signals, and control signals output by the timing control board 100 include control signals required by a source drive circuit and a gate drive circuit.

In this embodiment, different point-to-point configuration parameters are stored in different storage modules 30, and the number and sizes of the storage modules 30 can be set according to requirements without specific restrictions.

When the point-to-point interface 20 is used, the timing controller 10 and the source drive circuit on the source drive circuit board 200 communicate through data pairs, and clock signals are embedded in data signals.

In this embodiment, in order to identify a protocol type supported by the matched source drive circuit board 200 to output corresponding data signals and clock signals, at least one common port I/O is also provided on that timing control 10. The common port is connected to the source drive circuit on the source drive circuit board 200. The timing controller 10 determines the protocol type supported by the source drive circuit board 200 based on the configuration parameter feedback signal received by the common port I/O, and correspondingly outputs the chip selection signal to a corresponding storage module 30 of the plurality of storage modules 30, and obtain corresponding point-to-point configuration parameters. The timing controller 10 performs initialization and configuration of parameter settings for itself, such as power supply parameter configuration, data signal configuration, clock signal configuration, etc. according to the point-to-point configuration parameters to output clock signals and data signals matching the source drive circuit board 200.

The configuration parameter feedback signal can be a digital signal or an analog signal, such as be a level signal that can be 1 or 0, or a binary code signal. The number of common ports I/O can be selected according to the number of storage modules, and can be one or more.

It can be understood that, the timing control board 100 may determine the protocol type supported by the source drive circuit board 200 in a variety of ways, such as outputting a query signal to the source drive circuit board 200, and receiving the configuration parameter feedback signal output by the source drive circuit board 200, or being directly connected to the source drive circuit of the source drive circuit board 200, and obtaining working parameters of the source drive circuit. Different source drive circuit boards 200 supporting different point-to-point protocol types has different source drive circuit with different structure designs, for example, working currents and voltage of pull-up resistor circuits or pull-down resistor circuits for clamping in different source drive circuit boards 200 are different. Therefore, feedback signals obtained by the common ports I/O are different, so that a chip selection signal can be output to a corresponding storage module to obtain corresponding point-to-point configuration parameters. The timing controller 10 outputs the matched data signals and clock signals to the source drive circuit board 200 through the point-to-point interface 20 to pair with the source drive circuit board 200 and performs data transmission.

In this embodiment, the timing control board includes a point-to-point interface 20, a plurality of storage modules 30 and a timing controller 10. The point-to-point interface 20 is for connecting the source drive circuit board and performing point-to-point signal transmission. Each of the plurality of storage modules 30 stores a set of point-to-point configuration parameters, and point-to-point configuration parameters stored by the plurality of storage modules 30 are different from each other. At least one common port I/O is also provided on that timing controller 10 and connected to a signal terminal of the source drive circuit board 200. The timing controller 10 receives a configuration parameter feedback signal output by the source drive circuit board 200 through the common port I/O, and outputs corresponding chip selection signals to a plurality of storage modules according to the configuration parameter feedback signal, so as to obtain a set of point-to-point configuration parameters matching a protocol type of the source drive circuit board 200 from one of the plurality of storage modules 30, and perform self initialization setting according to the point-to-point configuration parameters to generate matched data signals and clock signals. The matched data signals and clock signals are output to the source drive circuit board 200 through the point-to-point interface 20, so as to realize compatibility of the display panel 300 and reduce design cost.

In an alternative embodiment, the common port I/O is connected to a pull-up resistor circuit or a pull-down resistor circuit of the source drive circuit board 200.

The timing controller is for receiving the configuration parameter feedback signal output by the pull-up resistor circuit or the pull-down resistor circuit of the source drive circuit board 200 through the common port I/O.

In this embodiment, the source drive circuit board 200 is provided with a pull-up resistor circuit or a pull-down resistor circuit for clamping. The working currents and voltages of pull-up resistor circuits or pull-down resistor circuits of different source drive circuit boards 200 are different. Therefore, voltage and current feedback signals obtained via the common ports I/O are different. The common port I/O may be connected to the pull-up resistor circuit or the pull-down resistor circuit of the source drive circuit board 200. The obtained configuration parameter feedback signal is compared with a preset reference value to determine the protocol type supported by the source drive circuit board 200. The chip selection signal is output to a correspondingly storage module to obtain the corresponding point-to-point configuration parameters of the source drive circuit board 200 to perform self parameter configuration.

In still an alternative embodiment, the point-to-point interface 20 includes a first signal interface and a second signal interface. The timing controller 10 outputs clock signals and data signals through the first signal interface, and outputs level synchronization signals through the second signal interface. The level synchronization signals for identifying level states for clock synchronization between the timing controller 10 and the source drive circuit board 200 in conjunction with the first signal port.

Specifically, during panel driving, the point-to-point high-speed signal transmission technology is used to carry out signal transmission, It is characterized in that a one-to-one correspondence relationship between first signal interfaces of two chips (e.g., the timing controller 10 and the source drive chip) of a panel drive circuit is established, so as to transmit high-speed differential data signals therebetween. Usually, clock signals are embedded in data signals, and the source drive chip restores the clock signals according to characteristics of received signals. The timing controller 10 is further provided with an additional second signal interface. A plurality of source drive chips are connected in parallel and connected to the second signal interface. The second signal interface is for identifying the level states for clock synchronization between the timing controller 10 and the source drive chips in cooperation with the first signal interface.

In still an alternative embodiment, each of the storage modules 30 is a flash memory or a read-only memory.

In this embodiment, the flash memory is a non-volatile memory, and data in the flash memory can be maintained for a long time without current supply. The flash memory has the storage characteristics equivalent to that of a hard disk. Different storage areas of the flash memory store different sets of point-to-point configuration parameters and are connected with the timing controller 10 through a serial peripheral interface for data transmission. The flash memory can be provided with multiple pins to connect with the timing controller 10, including input and output pins, chip selection signal pins, etc.

The read-only memory is a solid semiconductor memory and data pre-stored in the read-only memory can be read only and cannot be changed or deleted. Read-only memories are usually used in electronic or computer systems that do not need to change data frequently, and the data will not disappear due to turning off of power supply. The read-only memories have simple structures and the data in them are convenient to be read, thus, the read-only memories are often used to store various fixed programs and data.

Therefore, the flash memory or the read-only memory can be selected to be used in the timing control board 100 according to requirements.

Further, in an embodiment, each of the storage modules 30 is a flash memory, and point-to-point configuration parameters in the flash memory can be written and erased.

To further improve the compatibility of the timing control board 100, the point-to-point configuration parameters stored in the flash memory can be written and erased to adapt to more types of source drive circuit board 200. The point-to-point configuration parameters can be burned to the flash memory via a reserved burning port of the flash memory or through an input port of the timing control board 100. A specific burning mode can be selected according to requirements, without specific restrictions.

Figure 2:
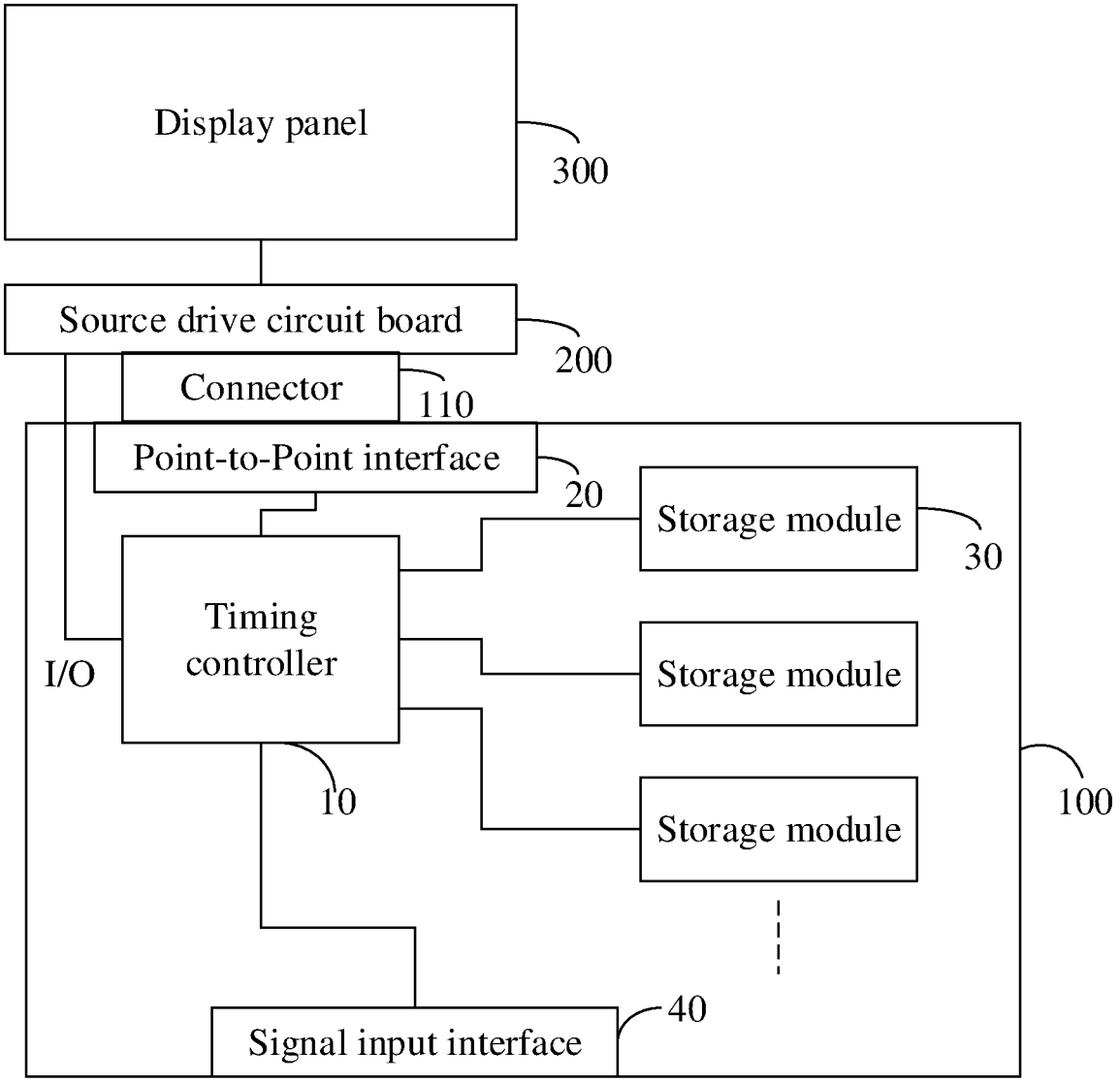
FIG. 2 is a block diagram of a second embodiment of the timing control board of the present disclosure.

FIG. 2 is a block diagram of a second embodiment of the timing control board 100 of the present disclosure. In order to ensure a stable connection between the timing control board 100 and the source drive circuit board 200, In this embodiment, the timing control board 100 further includes a connector 110 to connect the point-to-point interface 20 and the source drive circuit board 200. The connector 110 can use a flexible circuit board (PFC) connector to enable the timing control board 100 to connect with different types of source drive circuit boards 200, so as to ensure consistent pin sequence of power supply signals and control signals. For example, a pull-out PFC connector or a front-lid PFC connector can be used. A specific structure of the PFC connector can be selected according to an actual situation and is not specifically limited herein.

Figure 3:
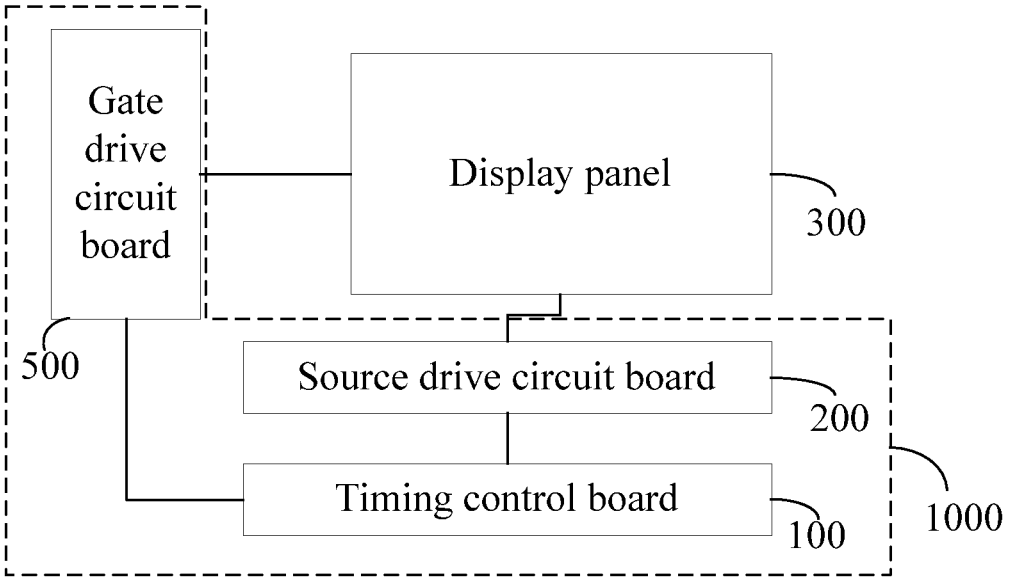
FIG. 3 is a block diagram of an embodiment of a drive device of the present disclosure.

As shown in FIG. 3, FIG. 3 is a block diagram of an embodiment of a drive device of the present disclosure. The present disclosure provides a drive device 1000. the drive device 1000 includes a source drive circuit board 200, a gate drive circuit board 500 and a timing control board 100. The specific structure of the timing control board 100 refers to the above-mentioned embodiments. Since the drive device 1000 of the present disclosure adopts all the technical solutions of all the above-mentioned embodiments, it has at least all the beneficial effects brought by the technical solutions of the above-mentioned embodiments, which will not be repeated here. The timing control board 100 is connected to the source drive circuit board 200 and the gate drive circuit board 500, respectively. The source drive circuit board 200 and the gate drive circuit board 500 are connected to data lines and scan lines of the display panel 300, respectively, and output analog gray-scale voltage signals and row scan signals to drive the display panel 300, respectively.

In this embodiment, the gate drive circuit board 500 may be directly connected to the timing control board 100, or through the source drive board. A specific connection mode between the gate drive circuit board 500 and the timing control board 100 is designed according to an actual structure of the display panel 300 without specific restrictions. The source drive circuit board and the gate drive circuit board 500 receive the control signals output by the timing control board 100, and correspondingly output analog voltage signals and row scanning signals of different voltage levels to drive the display panel 300 to work.

The present disclosure further provides a display device. The display device includes a drive device 1000 and a display panel 300. A specific structure of the drive device refers to the above-mentioned embodiments. Since the display device adopts all the technical solutions of the above-mentioned embodiments, it has at least all the beneficial effects brought by the technical solutions of the above-mentioned embodiments, which will not be repeated here.

The foregoing are only alternative embodiments of the present disclosure and are not thus limiting the claimed scope of the present disclosure. Any equivalent structural transformation made by utilizing the contents of the specification and the accompanying drawings of the present disclosure, or direct/indirect application in other related technical fields, is included in the claimed scope of the present disclosure.

What is claimed is:

1. A timing control board, comprising:

a point-to-point interface for connecting a source drive circuit board and performing point-to-point signal transmission;

a plurality of storage modules, each of the plurality of storage modules storing a set of point-to-point configuration parameters, and sets of point-to-point configuration parameters stored in the plurality of storage modules being different from each other; and a timing controller connected with the point-to-point interface, the source drive circuit board and the plurality of storage modules, and provided with at least one common port to connect with a signal terminal of the source drive circuit board, wherein the timing controller is for:

receiving a configuration parameter feedback signal output by the source drive circuit board through the common port, outputting a corresponding chip selection signal to the plurality of storage modules according to the configuration parameter feedback signal, to obtain a set of point-to-point configuration parameters from one of the plurality of storage modules, the set of point-to-point configuration parameters matching a protocol type of the source drive circuit board, initializing settings according to the set of point-to-point configuration parameters to generate matched data signals and clock signals, and outputting the data signals and the clock signals to the source drive circuit board through the point-to-point interface, wherein the common port is connected to a pull-up resistor circuit or a pull-down resistor circuit of the source drive circuit board;

the timing controller is for receiving the configuration parameter feedback signal output by the pull-up resistor circuit or the pull-down resistor circuit of the source drive circuit board through the common port.

2. The timing control board of claim 1, further comprising a signal input interface for receiving a synchronous drive signal for driving the display panel.

3. The timing control board of claim 1, wherein, the point-to-point interface comprises a first signal interface and a second signal interface, the timing controller is for outputting the clock signals and the data signals through the first signal interface, and outputting a level synchronization signal through the second signal interface, and the level synchronization signal is for identifying a level state for clock synchronization between the timing controller and the source drive circuit board in conjunction with the first signal interface.

4. The timing control board of claim 1, wherein each of the plurality of storage modules is a flash memory or a read-only memory.

5. The timing control board of claim 1, further comprising a connector for connecting the point-to-point interface and the source drive circuit board.

6. The timing control board of claim 5, wherein the connector is a flexible circuit board connector.

7. The timing control board of claim 1, wherein the timing controller is connected to the plurality of storage modules through a serial peripheral interface.

8. A drive device, comprising:

a source drive circuit board connected with a data line of a display panel and for outputting analog gray scale voltage signals to drive the display panel;

a gate drive circuit board connected with a scanning line of the display panel and for outputting row scanning signals to drive the display panel; and a timing control board of claim 1 connected with the source drive circuit board and the gate drive circuit board.

9. The drive device of claim 8, further comprising a signal input interface for receiving a synchronous drive signal for driving the display panel.

10. The drive device of claim 8, wherein, the point-to-point interface comprises a first signal interface and a second signal interface, the timing controller is for outputting the clock signals and the data signals through the first signal interface, and outputting a level synchronization signal through the second signal interface, and the level synchronization signal is for identifying a level state for clock synchronization between the timing controller and the source drive circuit board in conjunction with the first signal interface.

11. The drive device of claim 8, wherein each of the plurality of storage modules is a flash memory or a read-only memory.

12. The drive device of claim 8, further comprising a connector for connecting the point-to-point interface and the source drive circuit board.

13. The drive device of claim 12, wherein the connector is a flexible circuit board connector.

14. The drive device of claim 8, wherein the timing controller is connected to the plurality of storage modules through a serial peripheral interface.

15. A display device comprising a display panel and a drive device of claim 8, wherein a signal terminal of the display panel is connected to a signal terminal of the drive device.

16. A timing control board, comprising:

a point-to-point interface for connecting a source drive circuit board and performing point-to-point signal transmission, and comprising a first signal interface and a second signal interface;

a plurality of storage modules, each of the plurality of storage modules storing a set of point-to-point configuration parameters, and sets of point-to-point configuration parameters stored in the plurality of storage modules being different from each other; and a timing controller connected with the point-to-point interface, the source drive circuit board and the plurality of storage modules, and provided with at least one common port to connect with a pull-up resistor circuit or a pull-down resistor circuit of the source drive circuit board;

wherein the timing controller is for:

receiving a configuration parameter feedback signal output by the pull-up resistor circuit or the pull-down resistor circuit of the source drive circuit board through the common port, outputting a corresponding chip selection signal to the plurality of storage modules according to the configuration parameter feedback signal, to obtain a set of point-to-point configuration parameters from one of the plurality of storage modules, the set of point-to-point configuration parameters matching a protocol type of the source drive circuit board, initializing settings according to the set of point-to-point configuration parameters to generate matched data signals and clock signals, and outputting the data signals and the clock signals to the source drive circuit board through the point-to-point interface;

the timing controller is further for:

outputting the clock signals and the data signals through the first signal interface, and outputting a level synchronization signal through the second signal interface, and the level synchronization signal is for identifying a level state for clock synchronization between the timing controller and the source drive circuit board in conjunction with the first signal interface.

* * * * *